US007677320B2

(12) United States Patent
Shaw et al.

(10) Patent No.: US 7,677,320 B2
(45) Date of Patent: Mar. 16, 2010

(54) SUBSEA WELL WITH ELECTRICAL SUBMERSIBLE PUMP ABOVE DOWNHOLE SAFETY VALVE

(75) Inventors: Chris K. Shaw, Tulsa, OK (US); Michael V. Smith, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 510 days.

(21) Appl. No.: 11/451,213

(22) Filed: Jun. 12, 2006

(65) Prior Publication Data

US 2007/0289747 A1 Dec. 20, 2007

(51) Int. Cl.
*E21B 43/01* (2006.01)

(52) U.S. Cl. ..... 166/368; 166/339; 166/351; 166/369; 166/370

(58) Field of Classification Search ..... 166/368, 166/339, 344, 347, 348, 351, 363, 366, 369, 166/370, 372, 381
See application file for complete search history.

(56) References Cited

U.S. PATENT DOCUMENTS 4,440,221 A * 4/1984 Taylor et al. ..... 166/106
6,138,765 A * 10/2000 Russell et al. ..... 166/387
6,298,917 B1 * 10/2001 Kobylinski et al. ..... 166/369
6,328,111 B1 * 12/2001 Bearden et al. ..... 166/381
6,412,562 B1 7/2002 Shaw
6,415,864 B1 7/2002 Ramakrishnan et al.
6,497,287 B1 12/2002 Podio et al.
6,508,308 B1 * 1/2003 Shaw ..... 166/313
6,688,392 B2 * 2/2004 Shaw ..... 166/366
6,705,404 B2 3/2004 Bosley
2005/0016735 A1 * 1/2005 Ireland et al. ..... 166/352
2005/0217857 A1 10/2005 Rodrigues et al.

FOREIGN PATENT DOCUMENTS

GB 2094855 A 9/1982
GB 2347156 A 8/2000
GB 2360302 A 9/2001

* cited by examiner

*Primary Examiner*—Thomas A Beach
*Assistant Examiner*—Matthew R Buck
(74) *Attorney, Agent, or Firm*—Bracewell & Giuliani LLP

(57) ABSTRACT

A subsea well production system has a natural drive mode and a lift-assist mode using a submersible pump. The submersible pump can be installed while the well is live. The well system has a downhole safety valve in the production tubing. The operator closes the downhole safety valve and lowers an electrical submersible pump assembly into the production tubing. Once landed, the valve is opened and the pump assembly placed in operation.

5 Claims, 2 Drawing Sheets

SUBSEA WELL WITH ELECTRICAL SUBMERSIBLE PUMP ABOVE DOWNHOLE SAFETY VALVE

FIELD OF THE INVENTION

This invention relates in general to submersible well pump installations, and in particular to a submersible well pump located within production tubing above a downhole safety valve.

BACKGROUND OF THE INVENTION

Because of the expense of offshore oil and gas drilling, most wells have sufficient internal formation pressure to flow naturally. However, the internal formation pressure declines as the well fluid is produced over time. Consequently, there are subsea wells that have been shut in because the internal pressure was not adequate. Also there are subsea wells that continue to produce but at a rate below their actual potential. The reduction in production is due not only to a decline in reservoir pressure, but also because of an impairment of the reservoir and/or an increase in fluid gradient. One or a combination of these factors can render the well unable to produce fluid to the processing facility. This is particularly a problem in very deep water where even if the pressure at the wellhead is positive, it may be inadequate to flow the reservoir fluid to a floating production vessel at the surface.

Proposals have been made to install pumps adjacent to or on the production tree. Also, it has been proposed to install electrical submersible pumps (ESP) in nearby specially drilled caissons, which are shallow bores drilled into the sea floor. It has also been proposed to install an ESP in a production riser section extending from the subsea well to the production vessel. Another proposal involves installing an ESP within the production tubing after the reservoir pressure declines.

For safety, if a well is live or has positive pressure at the wellhead, the well is killed before lowering the ESP into the well. Killing the well typically involves pumping a heavy fluid into the well to prevent an accidental blowout while the ESP is being lowered into the well. However, killing a well can cause damage to the formation from the kill fluid. After killing the well, it is possible that the well may not again return to its former pressure level. Because of the risk, killing a live subsea well to install an ESP is not normally done. There have also been proposals to install ESPs in live land wells using various techniques, but these proposals are not easily applicable to subsea wells with subsea production trees.

General safety rules require that a well have at least two pressure barriers at all times, even when undergoing a workover. During its natural reservoir drive, the well fluid is normally produced through tubing that is suspended in the wellhead assembly at the sea floor surface by a tubing hanger. The tubing hanger seals within the wellhead assembly or production tree to provide one pressure barrier. Normally, there will be at least one other structure, such as a tree cap, to provide an additional safety barrier during production.

For offshore wells, downhole safety valves are installed a relatively short distance below the sea bed within the production tubing. A downhole safety valve is a type of valve that is biased closed and held open with hydraulic fluid pressure. If the hydraulic fluid pressure fails, the valve will close. Consequently, in the event that the wellhead assembly is damaged, or if the hydraulic fluid pressure is lost, the valve will close.

While a closed downhole safety valve could serve as a second pressure barrier during the installation of an ESP, the valve would have to be open when the ESP passes through it. Normally, ESPs are located deep within the well, far below the downhole safety valve and just above the perforations leading to the reservoir so as to achieve the most efficient production boost.

SUMMARY OF THE INVENTION

In this invention, a subsea well has a string of production tubing and a subsea safety valve located therein a selected distance below the wellhead assembly. When the production declines to an unsatisfactory level, an ESP is installed in an operational position within the production tubing above the valve. The ESP boosts well fluid pressure while the valve is open. Closing the valve enables the pump assembly to be installed within the well while live, because the valve serves as a pressure barrier. This feature allows the operator to install an ESP within a subsea well that is live without first killing the well.

DETAILED DESCRIPTION OF THE PREFERRED EMBODIMENT

Figure 1A:
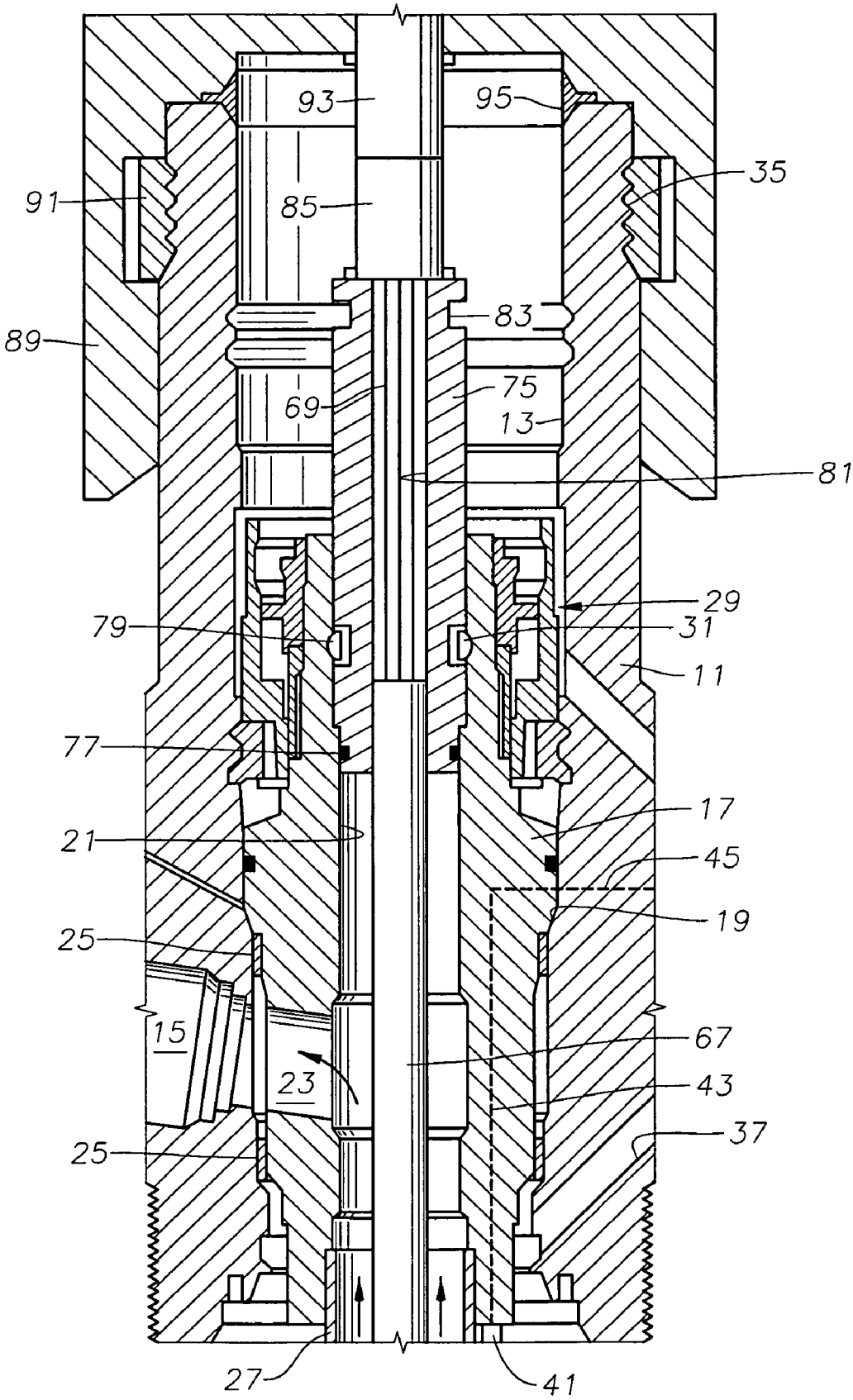
FIGS. 1A, 1B and 1C comprise a partially schematic sectional view illustrating a subsea well having an ESP installed in accordance with this invention.

Referring to FIG. 1A, a portion of a subsea well assembly is illustrated. In this example, the subsea wellhead assembly comprises a production or Christmas tree 11. Tree 11 has a bore 13 extending through it and lands on a high pressure wellhead housing (not shown) located on this sea floor. Tree 11 has a lateral flow passage 15 that extends laterally outward through its side wall from bore 13.

In this example, a production tubing hanger 17 lands in bore 13 of tree 11 on a landing shoulder 19. The tubing hanger lands on a shoulder in the high pressure wellhead housing with another type of tree (not shown). Production tubing hanger 17 has a vertical or axial flow passage 21. A lateral flow passage 23 extends laterally from vertical flow passage 21 and registers with tree lateral flow passage 15. Tree 11 has various valves (not shown) for controlling the flow of well fluid through lateral flow passage 15. Production tubing hanger 17 has external seals 25 that seal above and below lateral flow passage 23. Production tubing hanger 17 is located at the upper end of and supports a string of production tubing 27 that extends through one or more strings of casing 28 (FIG. 1B) in the well.

Tubing hanger 17 has a lock-down device 29 that when actuated by a running tool (not shown), locks tubing hanger 17 to a profile or groove located within tree bore 13. Production tubing hanger 17 also has a wireline plug profile 31 located within its vertical flow passage 21. During natural reservoir drive production, a wireline plug (not shown) will be located within tubing hanger passage 21 and locked to profile 31. The wireline plug forms a seal that will require production fluid to flow out lateral passages 23 and 15.

Production tree 11 has an external groove or profile 35 that may be of various shapes. Normally, while running production tubing hanger 17 and completing the well, a drilling riser with a blowout preventer (not shown) will connect to tree profile 35, and production tubing hanger 17 is lowered through the riser and blowout preventer. After installing tubing hanger 17, completing and testing the well, the drilling riser is removed and typically an internal tree cap (not shown) is secured sealingly within tree bore 13.

Production tree 11 has a tubing annulus passage 37, of which only a portion is shown. Passage 37 leads to valves (not shown) for opening and closing communication with the tubing annulus inside casing 28 (FIG. 1B) and on the exterior production tubing 27. The control of the tubing annulus allows the operator to circulate fluid down production tubing 27 and back up the tubing annulus or vice versa.

Figure 1B:
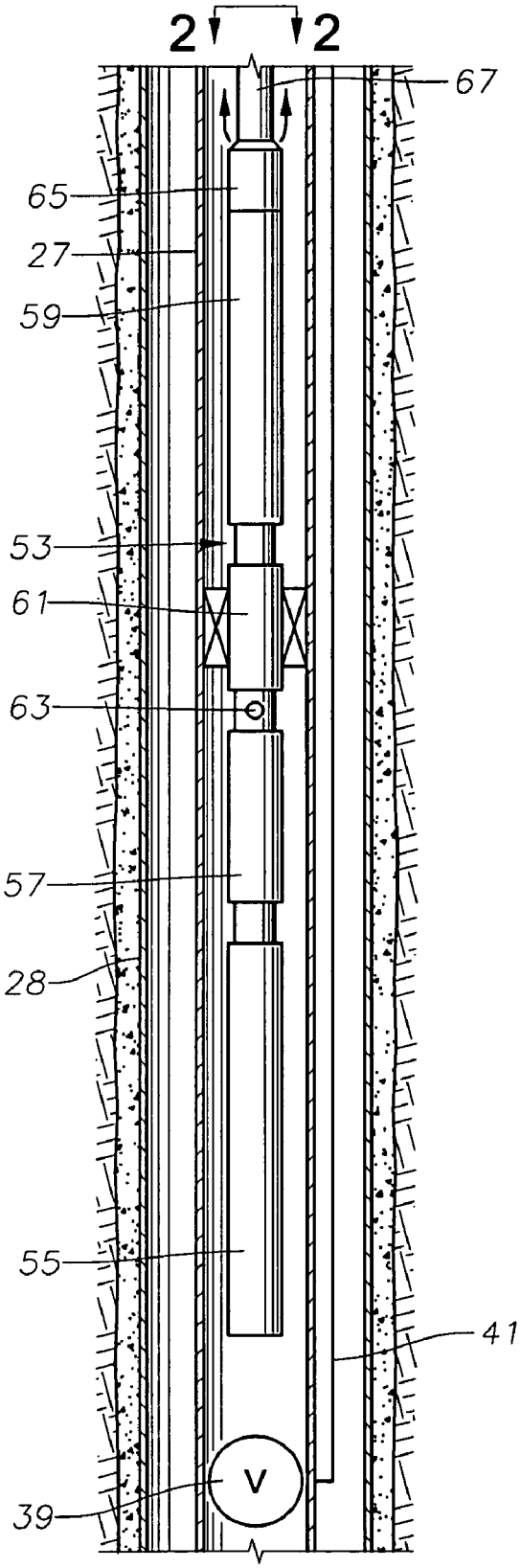

Referring to FIG. 1B, a downhole or subsea safety valve 39 is schematically shown located within production tubing 27. Safety valve 39 is conventional and is located at a conventional location for a subsea well. That location is fairly close to production tree 11, such as no more than a few hundred feet. Safety valve 39 is much closer to production tree 11 than to the lower end of production tubing 27, which is normally thousands of feet below. Downhole safety valve 39 may be of various types that are employed to close tubing 27 automatically in the event of an emergency. One common type is biased by a spring to a closed position and has one or more hydraulic lines 41 that lead from the tree 11 to valve 39 to maintain valve 39 open. Hydraulic line 41 connects to a passage 43 within tubing hanger 17. Passage 43 has a lateral outlet that registers with a passage 45 extending through the side wall of tree 11 to a supply of hydraulic fluid pressure. Seals (not shown) seal the junction between passages 43 and 45. In the event of a loss or the turning off of hydraulic fluid pressure to hydraulic fluid line 41, valve 39 will automatically close.

Figure 1C:
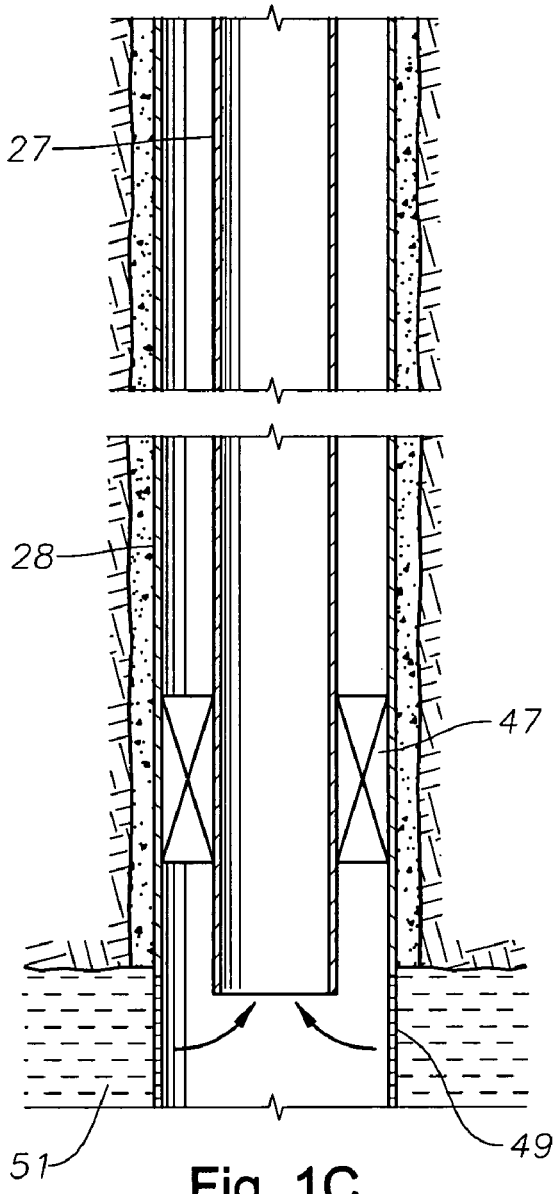

Referring to FIG. 1C, typically with a natural drive subsea well, a packer 47 will seal between casing 28 and production tubing 27. Packer 47 is located above perforations 49 within casing 28. Perforations 49 communicate with a reservoir or formation 51 for producing well fluid. The assembly at the lower end of production tubing 27 may also include a sliding valve (not shown) that is actuated between open and closed position to enable the operator to circulate between the interior of the tubing and the annulus surrounding production tubing 27.

Referring to FIG. 1B, an electrical submersible pump (ESP) is lowered into production tubing 27 in the event that the natural flow rate declines to an unsatisfactory level. ESP assembly 53 may be different types of rotary pumps. In this embodiment, ESP assembly 53 includes a downhole motor 55 that is connected to a seal section 57. Seal section 57 equalizes the pressure of internal lubricant within motor 55 with the external well fluid pressure. Pump 59 in this embodiment is a centrifugal pump having a large number of stages, each stage having an impeller and a diffuser.

In this embodiment, ESP assembly 53 has a packer 61 incorporated with it. Packer 61 is a releasable type of packer that seals the annulus between ESP 53 and the interior of production tubing 21. ESP packer 61 is located between pump intake 63 and the pump discharge, which is located in an adapter 65 at the upper end. ESP assembly 53 is supported by a conduit 67 connected to adapter 65. Conduit 67 could be a string of small diameter production tubing, but in this example comprises a string of continuous coiled tubing. The discharge from pump 59 is to the annular space surrounding conduit 67. Alternately, pump 65 could discharge into the interior of conduit 67, rather into the annulus surrounding conduit 67. In that event, a packer such as packer 61 would not be required.

Figure 2:
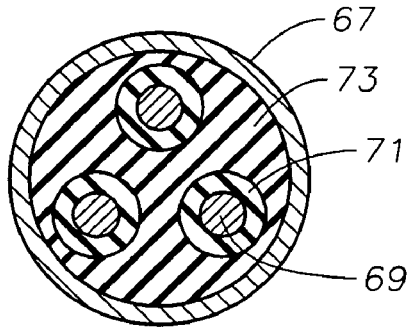
FIG. 2 is a sectional view of the coiled tubing of the ESP assembly of FIG. 1, taken along the line 2-2 of FIG. 1A.

In this example, the electrical power for motor 55 is supplied by an electrical cable that is located within conduit 67, shown in FIG. 2. If the discharge of pump 65 is alternately to the interior of conduit 67, the electrical cable could extend alongside conduit 67. The electrical power cable includes a plurality of electrical conductors 69, typically three, because the power is normally three-phase AC power. Each conductor 69 is covered by one or more layers of insulation 71. Also, the insulated conductors 69 are embedded within an elastomeric jacket 73 that frictionally grips the interior side wall of conduit 67. The power cable may be installed within coiled tubing or conduit 67 either by pulling a power cable through previously manufactured length of coiled tubing or by installing the power cable while welding a longitudinal seam of the coiled tubing.

Referring again to FIG. 1A, the upper end of conduit 67 is connected to a coiled tubing or conduit hanger 75, shown schematically. Conduit hanger 75 has a lower tubular portion that lands on a shoulder within production tubing hanger passage 21 and has one or more seals 77 that seal this lower tubular portion. Conduit hanger 75 has a lockdown device 79 to prevent pressure within passage 21 from pushing it upward. In this example, lockdown device 79 engages wireline plug profile 31 in tubing hanger 17 and is similar to the lockdown device utilized on wireline installed plugs. Lockdown device 79 is shown schematically and would typically be actuated by a running tool (not shown). The running tool engages a profile 83 on conduit hanger 75.

Various techniques for connecting electrical conductors 69 to a power source on the exterior of tree 11 may be employed. In this example, conduit hanger 75 has an electrical receptacle 85 that faces upward and is of a wet-mate type. A tree cap 89, which is shown to be an external type, slides over the upper end of tree 11. Tree cap 89 has locking members 91 that engage external profile 35 on tree 11. Locking members 91 are shown schematically and would be hydraulically moved inward and wedged in place.

Tree cap 89 has an electrical connector assembly 93 that will mate with electrical receptacle 85 when installed. Electrical connector assembly 93 typically has conductor pins or sleeves that will move from a retracted position to an extended position. The movement may be caused by a hydraulically or mechanically driven piston with the assistance of a remote operated vehicle (ROV) or by other means. External tree cap 89 seals tree bore 13 by means of a seal 95.

In operation, during its natural drive production, conduit hanger 75, conduit 67, ESP assembly 53, and external tree cap 89 will normally not be in place. Rather, a wireline installed plug (not shown) will be located at the upper end of production tubing hanger passage 21 in engagement with profile 31. Also, normally, an internal tree cap (not shown) will be located within bore 13 above tubing hanger 21. During normal production, downhole safety valve 39 (FIG. 1B) is open, and the well fluid flows up production tubing 27 and out lateral passages 23 and 15.

When the production of well fluid declines to an unsatisfactory level, the operator may wish to convert the well to lift-assist. This conversion may be done without killing the well. The operator closes downhole safety valve 39 and removes the existing internal tree cap (not shown). The tree cap may be removed with the assistance of a remote operated vehicle ("ROV"). The two pressure barriers at this point comprise downhole safety valve 39 and the wireline plug (not shown) previously installed within tubing hanger passage 21. The operator would then install a light intervention riser (not shown) to the upper end of tree 11. The light intervention riser connects to profile 35 and has a blowout preventer ("BOP"), and other equipment for subsea well intervention. The riser may be of a fairly small inner diameter, considerably smaller than tree bore 13, but it must be large enough for ESP assembly 53 and conduit hanger 75 to pass through it. The operator optionally could omit the riser and run the BOP in open water using drill pipe or a lift line.

After connecting the BOP, the operator uses a conventional tool to retrieve through the light intervention riser (if used) the wireline plug from production tubing hanger vertical flow passage 21. Once removed, the blowout preventer will maintain the desired second pressure barrier, with the first pressure barrier still being provided by the closed downhole safety valve 39. The operator then lowers ESP assembly 53 through the riser (if used) by connecting a running tool to profile 83 on conduit hanger 75. The length of conduit 67 is selected to place the lower end of ESP assembly 53 a short distance above downhole safety valve 39 once installed. Conduit hanger 75 will land on a shoulder in production tubing hanger passage 21 to support the weight of conduit 67 and ESP assembly 53. The lockdown mechanism 79 engages profile 31 to lock conduit hanger 75 in place. Conduit hanger 75 also serves as a plug to replace the plug initially removed.

The operator sets packer 61 by a conventional technique according to the type of packer. For example, this might include applying hydraulic fluid pressure or axial manipulation of conduit 67. A small hydraulic line could extend alongside conduit 67 from packer 61 through conduit hanger 75 and into electrical receptacle 85 for connection to a hydraulic fluid line within electrical connector 93. Alternately, a tube (not shown) could lead from one of the stages of pump 59 to packer 61 to inflate packer 61 when pump 59 operates by utilizing pump pressure.

Once ESP assembly 53 is installed, the operator removes the riser and installs tree cap 89. After the riser is removed and before installing tree cap 89, the second pressure barrier is provided by the coiled tubing hanger seals 77. The first pressure barrier continues to be supplied by the closed downhole safety valve 39. After securing tree cap 89, the operator uses an ROV to cause electrical connector 93 to make a wet-mate connection with the contacts in electrical receptacle 85. The operator then uses the ROV to connect the electrical lines leading from tree cap 89 to a power source located subsea.

Once ESP assembly 53 is fully installed, downhole safety valve 39 is opened and electrical power is supplied to motor 55. The well fluid flows up production tubing 27 and into intake 63 of pump 59. The well fluid flows out the discharge ports in adapter 65 and through the annulus surrounding conduit 67. The well fluid flows out the lateral flow passages 23 and 15.

If the wellhead assembly is of a type with the tubing hanger landed in the wellhead housing rather than the tree, a different method must be used. A lubricator would be installed on top of the tree to enable the operator to insert a plug through the tree and into the production passage in the tubing hanger. The lubricator is a tubular member that receives the plug running tool within a sealed chamber and seals against the line connected to the running tool as the tool is lowered through the lubricator and into the tree. Then, the tree would be removed with the downhole safety valve and plug providing two barriers. A BOP is then installed on the wellhead housing, preferably on a riser, to enable the plug to be removed and ESP assembly 53 lowered through the tubing hanger and installed above the downhole safety valve. The tree is then placed back onto the wellhead housing.

The invention has significant advantages. An operator is able to convert a natural flowing subsea well to one having a pressure assist without having to kill the well. The operator does not need to pull the tubing or remove the tree. The pressure boost provided by the pump increases the production rate as well as the life of the well.

While the invention has been shown in only one of its forms, it should be apparent to those skilled in the art that it is not so limited but susceptible to various changes without departing from the scope of the invention. For example, rather than land the coiled tubing hanger in the production tubing hanger, a spool configured to support the coiled tubing hanger could be mounted to the upper end of the production tree.

The invention claimed is:

1. A method of producing a subsea well having a wellhead assembly, a string of casing cemented in the well, a string of production tubing suspended from the wellhead assembly within the casing, and a downhole safety valve located within the production tubing, comprising:

(a) during a reservoir drive production mode, opening the valve and flowing well fluid through the production tubing and the wellhead assembly in response to internal reservoir pressure; and when the flow rate of the well fluid declines to an unsatisfactory level, (b) closing the valve, then lowering an electrical pump assembly through the wellhead assembly and into the production tubing to a depth above the valve, the electrical pump assembly having a smaller maximum outer diameter than any portion of the production tubing above the valve, the electrical pump assembly being provided with a radially expansible packer between its intake and its discharge; then (c) expanding the packer to an expanded position in sealing engagement with the production tubing, opening the valve and supplying electrical power to the pump assembly, causing the pump assembly to boost the pressure of the well fluid flowing upward through the production tubing;

wherein the wellhead assembly comprises a production tree having a bore sealed at an upper end by a removable first cap, and step (b) further comprises:

removing the first cap from the tree prior to lowering the pump assembly into the production tubing; and sealingly extending electrical conductors of a power cable through a second cap and connecting the conductors to the pump assembly; then installing the second cap after the pump assembly has been installed in the production tubing.

2. The method according to claim 1, wherein step (b) comprises connecting a riser and blowout preventer to the production tree and lowering the pump assembly through the riser.

3. A method of producing a subsea well having a wellhead assembly having a bore sealed at an upper end by a first cap, a string of casing cemented in the well, a string of production tubing suspended from the wellhead assembly within the casing, and a downhole safety valve located within the production tubing, comprising:

(a) during a reservoir drive production mode, opening the valve and flowing well fluid through the production tubing and the wellhead assembly in response to internal reservoir pressure; and when the flow rate of the well fluid declines to an unsatisfactory level, (b) closing the valve, removing the first cap, then lowering an electrical pump assembly through the wellhead assembly and into the production tubing to a depth above the valve, the electrical pump assembly being provided with a radially expansible packer between its intake and its discharge;

(c) expanding the packer to an expanded position in sealing engagement with the production tubing, (d) sealingly extending electrical conductors through a second cap, connecting the conductors to the pump assembly, and installing the second cap on the wellhead assembly; and (e) opening the valve and supplying electrical power through the conductors to the pump assembly, causing the pump assembly to boost the pressure of the well fluid flowing upward through the production tubing.

4. The method according to claim 3, wherein step (b) further comprises connecting a riser and blowout preventer to the wellhead assembly and lowering the pump assembly through the riser.

5. A method of producing a subsea well having a subsea production tree having a bore sealed at an upper end by a first cap, a string of casing cemented in the well, a string of production tubing suspended from the wellhead assembly within the casing, and a downhole safety valve located within the production tubing, comprising:

(a) during a reservoir drive production mode, opening the valve and flowing well fluid through the production tubing and the production tree in response to internal reservoir pressure; and when the flow rate of the well fluid declines to an unsatisfactory level, (b) closing the valve, removing the first cap and attaching a riser to the production tree, then lowering an electrical pump assembly into the production tree and the production tubing to a depth in the production tubing above the valve, the electrical pump assembly being provided with a radially expansible packer between its intake and its discharge;

(c) expanding the packer to an expanded position in sealing engagement with the production tubing, (d) sealingly extending electrical conductors through a second cap, connecting the conductors to the pump assembly, and installing the second cap on the production tree;

(e) disconnecting the riser from the production tree; and (f) opening the valve and supplying electrical power through the conductors to the pump assembly, causing the pump assembly to boost the pressure of the well fluid flowing upward through the production tubing.

* * * * *